US008382107B2

(12) United States Patent
Wu et al.

(10) Patent No.: US 8,382,107 B2
(45) Date of Patent: Feb. 26, 2013

(54) SHEET SEPARATING MECHANISM

(75) Inventors: Hongjun Wu, Guangzhou (CN); Linfa Zhang, Guangzhou (CN); Haifeng Xue, Guangzhou (CN)

(73) Assignee: GRG Banking Equipment Co., Ltd., Guangzhou, Guangdong (CN)

( * ) Notice: Subject to any disclaimer, the term of this patent is extended or adjusted under 35 U.S.C. 154(b) by 0 days.

(21) Appl. No.: 13/264,782

(22) PCT Filed: Mar. 22, 2010

(86) PCT No.: PCT/CN2010/071181
§ 371 (c)(1),
(2), (4) Date: Oct. 17, 2011

(87) PCT Pub. No.: WO2010/139205
PCT Pub. Date: Dec. 9, 2010

(65) Prior Publication Data

US 2012/0061905 A1 Mar. 15, 2012

(30) Foreign Application Priority Data

Jun. 5, 2009 (CN) ..... 2009 1 0040032

(51) Int. Cl.
*B65H 3/52* (2006.01)
*B65H 5/02* (2006.01)

(52) U.S. Cl. ..... 271/273; 271/124; 271/125; 271/274

(58) Field of Classification Search ..... 271/273, 271/274, 124, 125, 121, 137
See application file for complete search history.

(56) References Cited

U.S. PATENT DOCUMENTS 5,273,269 A * 12/1993 Iwanaga ..... 271/124
6,412,771 B1 7/2002 Kirata et al.
2005/0140081 A1 6/2005 Sugimura et al.
2005/0280199 A1 12/2005 Steinhilber et al.
(Continued)

FOREIGN PATENT DOCUMENTS

CN 1637637 A 7/2005
CN 1659091 A 8/2005
(Continued)

OTHER PUBLICATIONS

International Search Report dated Jul. 1, 2010 from International application No. WO2010139205.

*Primary Examiner* — Luis A Gonzalez
(74) *Attorney, Agent, or Firm* — Wolf, Greenfield & Sacks, P.C.

(57) ABSTRACT

A sheet separating mechanism is disclosed, which comprises a frame (380), at least one set of transferring rollers (110), a separating roller (120), a reverse rotating roller (130), an eccentric adjusting means (310), a driving component, and an elastic component (320). The at least one set of transferring rollers and the separating roller are connected to the frame through a first rotating shaft (210,220), respectively. The eccentric adjusting means includes an eccentric plate (311) and an eccentric adjusting plate (312). The eccentric plate has an outer ring (315) and an inner ring (314) adapted to move inside the outer ring. The inner ring is connected with a second rotating shaft (230) that is connected with the reverse rotating roller. The reverse rotating roller is separated from the separating roller to form a separation gap. The driving component drives the first and the second rotating shafts to rotate. One end of the elastic component is fixedly connected with the frame, and the other end is connected with the second rotating shaft. The separation gap of the mechanism can be adjusted on demand, which widens a thickness range of sheets, prevents multiple sheets from entering the separation gap, and thus avoids the jam of the separating roller.

8 Claims, 4 Drawing Sheets

U.S. PATENT DOCUMENTS

2006/0103066 A1 5/2006 Stoll et al.

FOREIGN PATENT DOCUMENTS

CN 1682251 A 10/2005
CN 101580183 A 11/2009
CN 101602442 A 12/2009
DE 10105521 8/2002
JP 6-247640 A 9/1994
JP 2002240976 8/2002

* cited by examiner

SHEET SEPARATING MECHANISM

This application claims priority to Chinese patent application titled "SHEET MATERIAL SEPARATION MECHANISM" with application No. 200910040032.3 filed on Jun. 5, 2009 with the State Intellectual Property Office of the People's Republic of China, the entire disclosure of the above application is incorporated into the present application by reference.

FIELD OF THE INVENTION

The present invention relates to a separation mechanism, and more specifically to a sheet material separation mechanism.

BACKGROUND OF THE INVENTION

The mechanization level of various areas is improved constantly with the constant development of our society; wherein, the sheet material separation technique for separating sheet materials, such as banknote, paper sheet, bill and the like, one by one is also greatly developed. Automated sheet material separation mechanisms are also more and more widely used in this technical area, for example, sheet material separation mechanisms are widely used in a cash access apparatus of an automatic teller machine (ATM), an bank cash/note sorting apparatus, a printer, a duplicator, a paper sheet separation apparatus for a printing press.

The existing sheet material separation mechanism for separating bank notes, paper sheets and bills generally comprises a frame, a plurality of conveying wheels, a separation wheel, a reversal wheel, a driving component, an eccentric adjustment device and a one-way bearing. The plurality of conveying wheels are directly rotatablely mounted on the frame by means of a conveying shaft, and may rotate with respect to the frame together with the conveying shaft; the separation wheel is directly rotatablely mounted on the frame by means of a separation shaft, and may rotate with respect to the frame together with the separation shaft; the reversal wheel is mounted on the frame by means of a reversal shaft and the eccentric adjustment device. The reversal wheel and the separation wheel are spaced apart by a predetermined distance to form a separating gap. The friction force generated between the separation wheel and a sheet material to be separated is greater than the friction force generated between the reversal wheel and the sheet material to be separated. The driving component comprises an electromotor and several synchronous belts, the electromotor drives the separation shaft, the conveying shaft and the reversal shaft to rotate via the synchronous belts, and consequently drives the separation wheel, the conveying wheel and the reversal wheel to rotate; at the same time, the driving component makes the separation wheel rotate in the same rotation direction as that of the conveying wheel, and makes the reversal wheel rotate in an opposite rotation direction to that of the separation wheel. The eccentric adjustment device comprises an eccentric adjustment plate and an eccentric plate, the eccentric plate and the eccentric adjustment plate are mounted respectively on the inner and outer sides of the frame through a fixing hole on the frame. The eccentric plate is mounted on the inner side of the frame, and comprises an outer ring and an inner ring suitable for moving within the outer ring. Inside the inner ring the one-way bearing is pressed; the reversal shaft is fitted into the one-way bearing, and the one-way bearing controls the rotation direction of the reversal shaft.

During the assembly process of the aforesaid sheet material separation mechanism, the eccentric adjustment plate is rotated to drive the inner ring of the eccentric plate to move within the outer ring, and then to drive the reversal shaft to move via the built-in one-way bearing, and consequently to drive the reversal wheel to move up and down so as to allow for adjusting the size of the separating gap. After the size of the separating gap is adjusted according to the regulation, the eccentric plate and the eccentric adjustment plate of the eccentric adjustment device are fixed on the frame by a fastening bolt, thereby the inner ring and the outer ring of the eccentric plate are fixed; after the inner ring of the eccentric plate is fixed, the separating gap between the separation wheel and the reversal wheel cannot be further adjusted.

When a separating operation is conducted using the sheet material separation mechanism, sheet materials to be separated are firstly put on the conveying wheel, then the sheet materials are conveyed to the separating gap between the separation wheel and the reversal wheel by the conveying wheel. Since the rotation direction of the reversal wheel is opposite to that of the separation wheel and the friction force applied by the separation wheel on the sheet material contacting with the separation wheel is greater than the friction force applied by the reversal wheel on the sheet material contacting with the reversal wheel, the sheet material contacting with the separation wheel will pass through the separating gap under the action of the friction force generated by the separation wheel, and be further conveyed to the transmission passage for the next operation; at the same time, other sheet materials are stopped outside the separating gap by the reversal wheel, the separation wheel and the reversal wheel cooperate with each other so that only one piece of the sheet material passes through the separating gap at a time.

From the above description, it can be seen that, in the prior art, the size of the separating gap is adjusted before separating the sheet material, and the eccentric adjustment device is fixed after the adjustment is finished; here, the inner ring of the eccentric plate is fixed and cannot move, the separating gap between the reversal wheel and the separation wheel is constant, the constant separating gap can only be suitable for sheet materials with fixed thickness, when there are old and new and/or different kinds of sheet materials with difference thickness, a separation failure easily occurs. In particular, the sheet material cannot go into the separating gap when the thickness of sheet material to be separated is greater than the separating gap, which results in a failure of separation; when the thickness of sheet material is smaller than the separating gap, plural pieces of the sheet material may synchronously go into the separating gap, thereby, not only the purpose that the sheet materials are separated one by one cannot be achieved, but also the separation wheel may be stuck due to an excessively large frictional resistance, thereby the whole sheet material separation mechanism cannot operate properly.

Therefore, it is necessary to provide an improved sheet material separation mechanism to overcome the shortcomings described above.

SUMMARY OF THE INVENTION

The purpose of the invention is to provide a sheet material separation mechanism, the size of the separating gap of the sheet material separation mechanism may be adjusted according to requirements, which can expand the thickness range of the material to be separated, and at the same time, avoid plural pieces of the sheet material from simultaneously going into the separating gap, thereby the separation wheel will not be stuck.

For achieving the aforesaid purpose, the invention provides a sheet material separation mechanism which comprises a frame, at least one group of conveying wheels, a separation wheel, a reversal wheel, an eccentric adjustment device and a driving component, wherein the at least one group of conveying wheels and the separation wheel are connected to the frame by means of first rotation shafts respectively, the eccentric adjustment device comprises an eccentric plate and an eccentric adjustment plate, the eccentric plate comprises an outer ring and an inner ring suitable for moving within the outer ring, the inner ring is connected with a second rotation shaft, the second rotation shaft is connected with the reversal wheel, the reversal wheel and the separation wheel are spaced apart from each other to form a separating gap, and the driving component drives the first rotation shafts and the second rotation shaft to rotate, and wherein the sheet material separation mechanism further comprises an elastic element, one end of the elastic element fixedly connected to the frame, and the other end connected with the second rotation shaft.

Preferably, the sheet material separation mechanism further comprises a rolling bearing, the elastic element is connected with the rolling bearing, and the rolling bearing is fitted over the second rotation shaft. The abrasion of the second rotation shaft due to the direct connection between the elastic element and the second rotation shaft is avoided.

Preferably, the driving component comprises an electromotor and synchronous belts, and the electromotor drives the first rotation shafts and the second rotation shaft to rotate via the synchronous belts.

Preferably, the driving component comprises a manual wheel and synchronous belts, and the manual wheel drives the first rotation shafts and the second rotation shaft to rotate via the synchronous belts under the action of an external force. When there is an unexpected malfunction of the sheet material separation mechanism, the manual wheel may be rotated by hand to drive the first rotation shafts and the second rotation shaft to rotate, and then to drive the conveying wheel and the separation wheel to rotate for achieving a manual separating operation.

Preferably, the eccentric plate is fixed on one side of the frame, and the eccentric adjustment plate is fixed on the other side of the frame.

Preferably, the friction coefficient of at least a part of the surface of the separation wheel is greater than the friction coefficient of at least a part of the surface of the reversal wheel. Therefore, the friction force applied by the part of the surface of the separation wheel on the sheet material contacting with it is greater than the corresponding friction force applied by the reversal wheel on the sheet material contacting with it, so that the separation wheel can exactly separate the sheet material contacting with it out of the separating gap under the action of the friction force.

Preferably, the maximum elastic compressive force applied on the second rotation shaft by the elastic element is greater than the acting force applied on the reversal wheel by a sheet material to be separated. The elastic compressive force of the elastic element makes the second rotation shaft stay in a fixed equilibrium position during the separation.

Preferably, the sheet material separation mechanism further comprises a one-way bearing, the one-way bearing is fitted over the second rotation shaft, the one-way bearing is fitted into the inner ring of the eccentric plate, and the outer diameter of the one-way bearing is smaller than the inner diameter of the inner ring. The one-way bearing controls the rotation direction of the second rotation shaft, and makes the second rotation shaft rotate only in one direction; and the one-way bearing may move up and down within the inner ring, consequently drive the second rotation shaft to move up and down, and lead to the upward and downward movement of the reversal wheel, thereby the separating gap between the reversal wheel and the separation wheel may be adjusted.

Compared with the prior art, the second rotation shaft of the sheet material separation mechanism of the invention is connected with the elastic element, therefore, when the sheet material going into the separating gap between the reversal wheel and the separation wheel presses the reversal wheel, the second rotation shaft connected to the reversal wheel presses the elastic element, which leads to the contraction of the elastic element, thereby the reversal wheel is driven to move via the second rotation shaft, therefore, the separating gap between the reversal wheel and the separation wheel is enlarged. Thus, the sheet material separation mechanism can automatically adjust the required size of the separating gap according to the different thickness of the sheet material to be separated, therefore, the thickness range of the material to be separated is expanded, and at the same time, the separating gap may also be set to be smaller to prevent plural pieces of the sheet material from simultaneously going into the separating gap, thus avoiding the sticking of the separation wheel.

BRIEF DESCRIPTION OF THE DRAWINGS

In order to describe the embodiments of the present invention or the technical solutions of the prior art more clearly, the drawings used in the embodiments will be briefly introduced below, it is apparent that the drawings described below are only some embodiments of the present invention, other drawings may also be obtained according to these drawings without creative work by the skilled in the art.

DETAILED DESCRIPTION OF THE INVENTION

The technical solutions in the embodiments of the invention will be described clearly and completely with reference to the drawings in the embodiments of the present invention. It is apparent that the described embodiments are only some of the present invention's embodiments rather than all of them. Other embodiments obtained based on the embodiments of the present invention by the skilled in the art without creative work are all within the protection scope of the present invention.

Now, the embodiments of the invention are described with reference to the drawings, similar element reference numbers represent similar elements throughout the drawings. As described above, the present invention provides a sheet material separation mechanism, and the size of the separating gap of the sheet material separation mechanism may be adjusted according to requirements, thereby the thickness range of the material to be separated is expanded, and at the same time, plural pieces of the sheet material can be prevented from synchronously going into the separating gap, and consequently the separation wheel will not be stuck.

Figure 1:
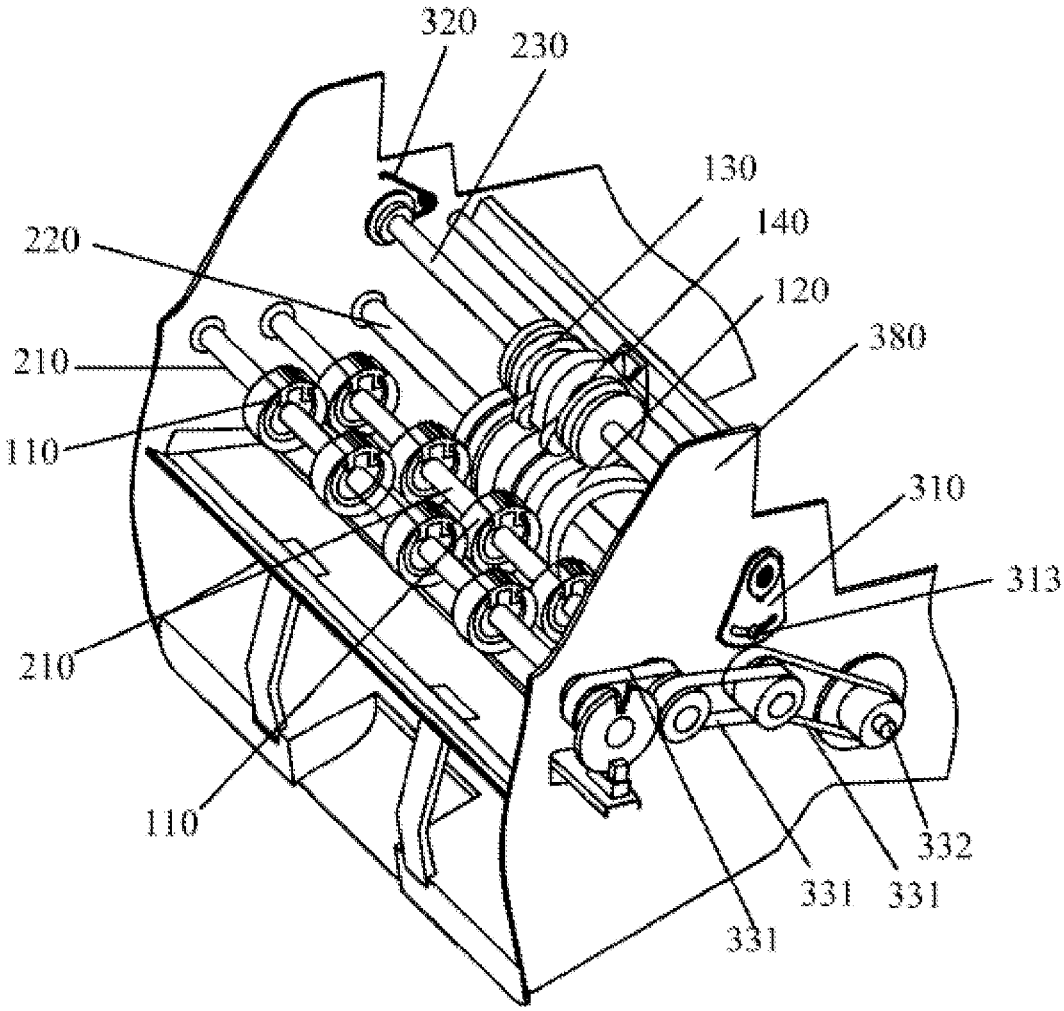
FIG. 1 is a schematic view of the sheet material separation mechanism of the present invention.
Figure 2:
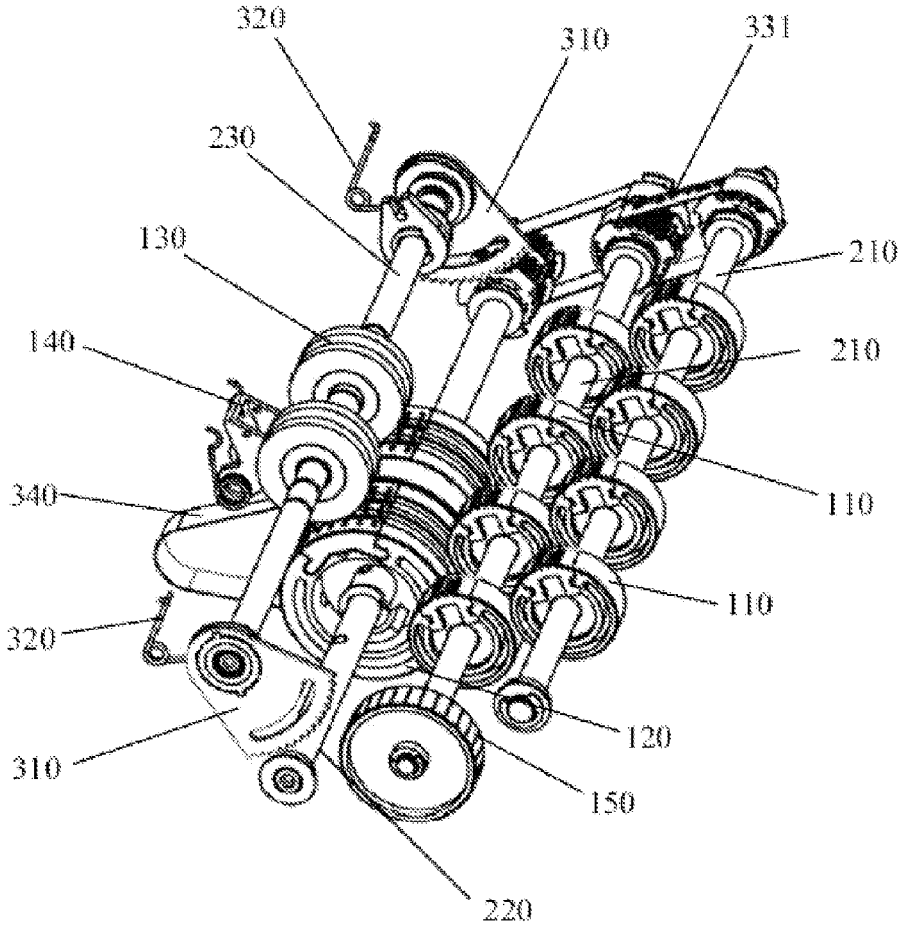
FIG. 2 is a partial schematic view of the sheet material separation mechanism shown in FIG. 1.

With reference to FIG. 1 and FIG. 2, the sheet material separation mechanism comprises a frame 380, a transmission floating wheel 140, a transmission passage 340, two groups of conveying wheels 110, a separation wheel 120, a reversal wheel 130, a driving component, an eccentric adjustment device 310, a second rotation shaft 230 and first rotation shafts 210, 220.

The transmission floating wheel 140 and the transmission passage 340 are fixedly mounted in turn, they and the conveying wheel 110 are located on the two sides of the separation wheel 120, respectively. The transmission floating wheel 140 is used to draw the separated sheet material and to convey the drawn sheet material to the transmission passage 340 for a subsequent operation.

The two groups of conveying wheels 110 are rotatablely connected to the frame 380 respectively by the first rotation shafts 210, and may rotate together with the first rotation shafts 210; in this example, there are two groups of conveying wheels 110 which are arranged to be parallel to each other. In addition, one group or plural groups of conveying wheels 110 may be mounted according to actual requirements during the design, and plural corresponding first rotation shafts 120 are provided.

Figure 5:
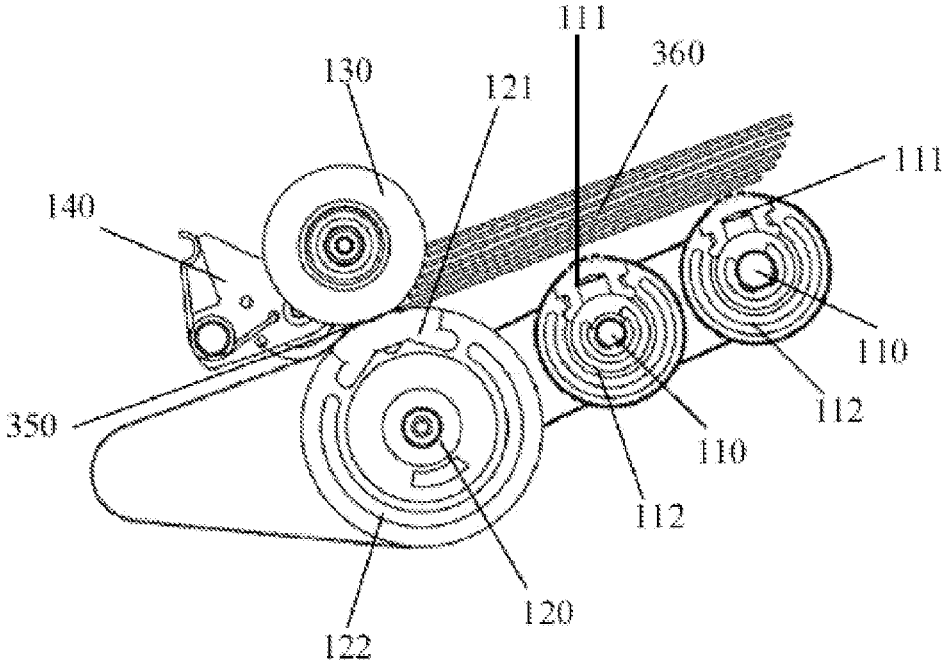
FIG. 5 is a schematic view of the section of the sheet material separation mechanism shown in FIG. 1 which is separating the sheet materials.

With reference to FIG. 5, the two groups of conveying wheels 110 each include a first friction coefficient part 111 and a second friction coefficient part 112. The friction coefficient of the first friction coefficient part 111 is greater than that of the second friction coefficient part 112; in this document, the friction coefficient of the corresponding part is the friction coefficient between the corresponding part and the sheet material to be separated. When the first friction coefficient part 111 contacts with the sheet material 360, the first friction coefficient part 111 of the conveying wheel 110 can convey the sheet material 360 to the separating gap 350 formed between the reversal wheel 130 and the separation wheel 120 by means of applying a large friction force; when the second friction coefficient part 112 contacts with the sheet material 360, the friction force generated between the second friction coefficient part 112 of the conveying wheel 110 and the sheet material 360 is very small, thereby the sheet material 360 will not be driven to move, and consequently the sheet material 360 stays in this position and waits for a subsequent separating operation.

With reference to FIG. 1 again, the separation wheel 120 is rotatablely connected to the frame 380 through the first rotation shaft 220, and may rotate together with the first rotation shaft 220; the separation wheel 120 comprises a first friction coefficient part 121 and a second friction coefficient part 122 (see FIG. 5), the friction coefficient of the first friction coefficient part 121 is greater than that of the second friction coefficient part 122.

The reversal wheel 130 is mounted on the frame 380 through the second rotation shaft 230 and the eccentric adjustment device 310. The friction coefficient of the reversal wheel 130 is smaller than that of the first friction coefficient part 121 of the separation wheel 120, and greater than that of the second friction coefficient part 122 of the separation wheel 120.

Since the friction coefficient of the first friction coefficient part 121 of the separation wheel 120 is greater than that of the reversal wheel 130, when the first friction coefficient part 121 of the separation wheel 120 contacts with the sheet material 360, the friction force applied on the sheet material 360 by the separation wheel 120 is greater than that applied on the sheet material 360 by the reversal wheel 130. Thus, the sheet material 360 that contacts with the separation wheel 120 is separated under the action of the friction force of the first coefficient part 121 of the separation wheel 120 and passes through the separating gap 350; other sheet materials are prevented from going into the separating gap 350 by the reversal wheel 130, achieving the purpose of separating the sheet materials one by one. The friction force between the second friction coefficient part 122 of the separation wheel 120 and the sheet material 360 is so small that it can be ignored, therefore, when the second friction coefficient part 122 rotates to a position in which it contacts with the sheet material 360, the second friction coefficient part 122 do not separate the sheet material 360, the separation wheel 120 conducts the next separating operation on other sheet materials 360 only after the transmission floating wheel 140 conveys the sheet material 360 to the transmission passage 340. From the above analysis, it can be seen that the second friction coefficient part 122 of the separation wheel 120 may guarantee that the next piece of the sheet material cannot be separated until the sheet material 360 contacting with the separation wheel 120 is drawn away by the transmission floating wheel 140.

The driving component comprises an electromotor 332 and several synchronous belts 331, the electromotor 332 drives the first rotation shafts 220, 210 through the synchronous belts 331, and makes the first rotation shafts 220, 210 rotate in the same direction, and consequently drives the separation wheel 120 and the conveying wheel 110 to rotate in the same direction. The second rotation shaft 230 is connected with another electromotor (not shown) through a synchronous belt (not shown), therefore, the other electromotor drives the second rotation shaft 230 to rotate and consequently drives the reversal wheel 130 to rotate. The aforesaid two electromotors make the rotation direction of the reversal wheel 130 opposite to that of the separation wheel 120. In addition, the driving component further comprises a manual wheel 150, the manual wheel 150 is fixedly mounted to one end of the first rotation shaft 210. When the electromotor 332 of the sheet material separation mechanism cannot operate properly due to an unexpected malfunction, the manual wheel 150 may be rotated so as to drive the first rotation shafts 220, 210 to rotate through the synchronous belts 331, and consequently to drive the separation wheel 120 and the conveying wheel 110 to rotate, thus the sticking of the sheet material on the separation wheel 120 resulted from the malfunction of the electromotor 332 may be avoided.

Figure 3:
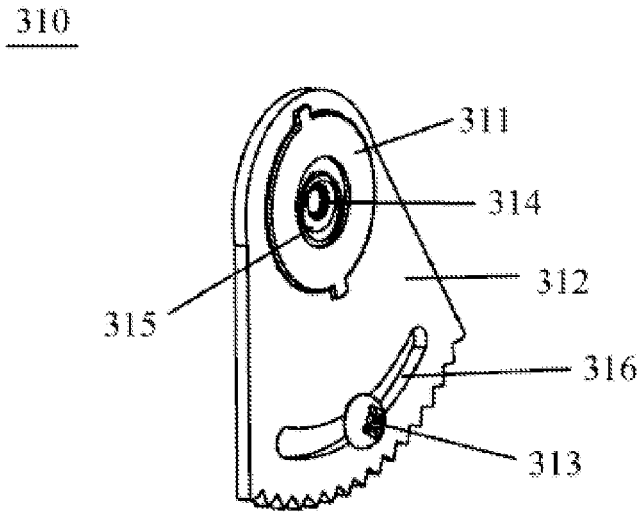
FIG. 3 is a structural schematic view of the eccentric adjustment device of the sheet material separation mechanism shown in FIG. 1.

With reference to FIG. 3, the eccentric adjustment device 310 comprises an eccentric plate 311 and an eccentric adjustment plate 312, the eccentric plate 311 and the eccentric adjustment plate 312 are mounted on the inner and outer sides of the frame 380 through a fixing hole (not shown) on the frame 380. The eccentric plate 311 comprises an outer ring 315 and an inner ring 314 suitable for moving within the outer ring 315. The outer ring 315 is embedded into the frame 380. A one-way bearing (not shown) is pressed into the inner ring 314, and the inner diameter of the inner ring 315 is greater than the outer diameter of the one-way bearing; the second rotation shaft 230 is fitted into the one-way bearing, and the one-way bearing controls the rotation direction of the second rotation shaft 230 and makes the second rotation shaft 230 rotate in one direction only. The eccentric adjustment plate 312 is provided with an arc-shaped slot 316, a bolt 313 passes through the arc-shaped slot 316 and fixes the eccentric adjustment device 310 onto the frame 380 (see FIG. 1). Before the eccentric adjustment device 310 is fixed, the eccentric adjustment plate 312 is rotated so as to make the eccentric adjustment plate 312 rotate, taking the arc-shaped slot 316 as the rotation arc, around the fixing hole on the frame 380, and consequently to drive the inner ring 314 of the eccentric plate 311 to rotate within the outer ring 315, and then to make the second rotation shaft 230 connected with the inner ring 314 through the inserted one-way bearing move, and then to drive the reversal wheel 130 to move, thereby the separating gap 350 may be adjusted to a proper dimension through rotating the eccentric adjustment plate 312 during the design assembly process. After the adjustment of the separating gap 350 is finished, the bolt 313 passes through the arc-shaped slot 316 so as to fix the eccentric adjustment device 310 on the frame 380, here, the size of the separating gap 350 cannot be further adjusted by means of the eccentric adjustment device 310.

Figure 4:
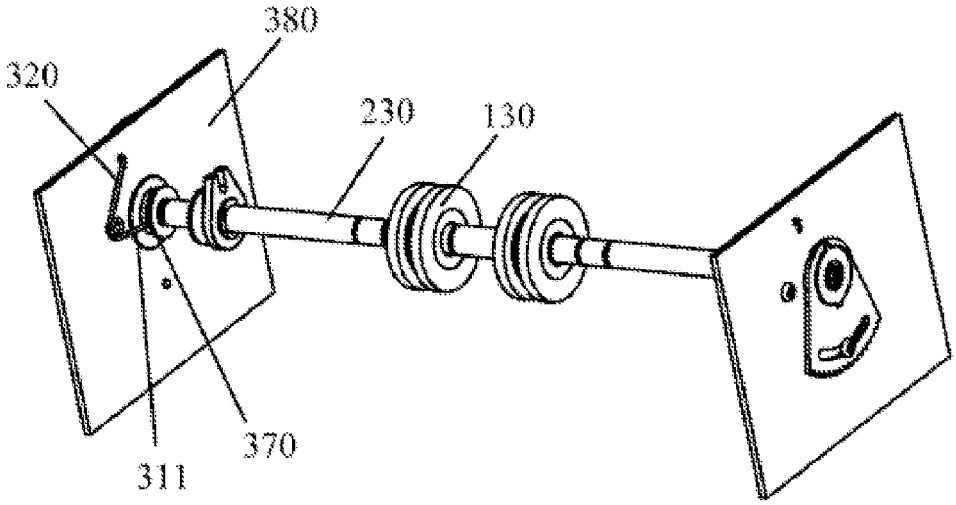
FIG. 4 is a schematic view of the connection between the elastic element and the second rotation shaft as well as the frame of the sheet material separation mechanism shown in FIG. 1.

With reference to FIG. 4, the sheet material separation mechanism further comprises a rolling bearing 370 and an elastic element 320, one end of the elastic element 320 is fixedly connected to the frame 380, and the other end is connected to the rolling bearing 370. The second rotation shaft 230 is fitted into the rolling bearing 370, the second rotation shaft 230 is connected to the elastic element 320 by means of the rolling bearing 370, which avoids the abrasion of the second rotation shaft 230 due to the direct connection between the elastic element 320 and the second rotation shaft 230. The elastic element 320 may expand/contract up and down by a pressure, and consequently can control the position of the second rotation shaft 230 and the one-way bearing within the inner ring 314, enabling the second rotation shaft 230 and the one-way bearing to move up and down within a predetermined range and thus achieving the purpose that the separating gap 350 formed by spacing the separation wheel 120 and the reversal wheel 130 apart from each other may be automatically adjusted.

During the assembly process, the eccentric adjustment plate 312 is rotated, the inner ring 314 together with the one-way bearing drives the second rotation shaft 230 to move within the outer ring 315, and thereby drives the reversal wheel 130 to move. The movement of the second rotation shaft 230 compresses the elastic element 320, which, in return, results in that the elastic element 320 makes the reversal wheel 130 stay in a proper fixed equilibrium position. Also, the rotation range of the eccentric adjustment plate 312 controls the movement range of the second rotation shaft 230 and the compression amount of the elastic element 320. When the movement range of the second rotation shaft 230 makes the separating gap between the reversal wheel 130 and the separation wheel 120 be minimum, the rotation of the eccentric adjustment plate 312 is stopped, and the eccentric adjustment device 310 is fixed on the frame 380 through the bolt 313, here, the elastic element 320 possesses a certain precompression amount. In addition, during the assembly process, the elastic compressive force generated on the second rotation shaft 230 by the elastic element 320 may be set to be greater than the compressive force applied on the reversal wheel 130 by the sheet material to be separated so as to satisfy the requirement that sheet materials with different thickness can pass through the separating gap.

The operating process of the sheet material separation mechanism of the invention will be described below with reference to FIG. 1 and FIG. 5.

The sheet materials 360 to be separated are put on the conveying wheel 110, and the electromotor 332 is started, which drives the first rotation shafts 210, 220 to rotate in the same direction through the synchronous belts 331, and then drives the conveying wheel 110 and the separation wheel 120 to correspondingly rotate in the same direction; at the same time, the other electromotor (not shown) is started, which drives the second rotation shaft 230 to rotate in a direction that is opposite to the rotation direction of the first rotation shaft 220 through a synchronous belt (not shown), and then drives the reversal wheel 130 to rotate in a direction that is opposite to the rotation direction of the separation wheel 120. Here, the startup of the electromotor 332 makes the conveying wheel 110 convey the sheet material 360 to the separating gap 350 formed by spacing the reversal wheel 130 and the separation wheel 120 apart from each other.

When the thickness of the sheet material conveyed to the separating gap 350 and contacting with the separation wheel 120 is greater than the separating gap 350, an acting force will be generated and applied on the reversal wheel 130 by the sheet material 360 contacting with the reversal wheel 130, the acting force is transferred to the elastic element 320 via the second rotation shaft 230 and rolling bearing 370 (see FIG. 4), and consequently presses the elastic element 320; the elastic element 320 contracts due to being pressed; here, the second rotation shaft 230, that is connected with the elastic element 320 through the rolling bearing 370, together with the one-way bearing moves up within the inner ring 314, thereby driving the reversal wheel 130 to move up, and the reversal wheel 130 will not stop moving up until a new balance between the compressive force acted on the second rotation shaft 230 by the elastic element 320 and the acting force applied on the reversal wheel 130 by the sheet material is obtained, thereby the an automatic adjustment of the size of the separating gap 350 is completed. Here, the size of the separating gap 350 formed by the reversal wheel 130 and the separation wheel 110 is substantially equal to the thickness of the sheet material contacting with the separation wheel 120. After the size of the separating gap 350 is automatically adjusted, the sheet material contacting with the separation wheel 120 goes into the separating gap 350, the first friction coefficient part 121 of the separation wheel 120 separates the sheet material contacting with it out of the separating gap 350; the separated sheet material can be drawn by the transmission floating wheel 140 and conveyed into the transmission passage 340 for a subsequent operation. Other sheet materials are stopped by the reversal wheel 130 so as to stay outside the separating gap 350, consequently, one separating operation is completed. After the sheet material contacting with the separation wheel 120 is completely separated out, the acting force applied on the reversal wheel 130 by this previous sheet material contacting with the separation wheel 120 disappears, here, the elastic element 320 returns to its precompression amount state so that the second rotation shaft 230 together with the one-way bearing moves down within the inner ring 314, thereby the reversal wheel 130 is driven to move down, the separating gap 350 returns to its minimum gap value.

When the thickness of the sheet material conveyed into the separating gap 350 and contacting with the separation wheel 120 is equal to the set minimum gap value, the acting force applied on the reversal wheel 130 by the sheet material contacting with the separation wheel 120 is very small, and smaller than the compressive force applied on the second rotation shaft 230 by the elastic element 320, therefore, the elastic element 320 still keeps its original precompression amount state and makes the second rotation shaft 120 stay in the fixed equilibrium position, the sheet materials can be smoothly separated without adjusting the separating gap 350.

The aforesaid process is repeatedly conducted until all sheet materials are completely separated one by one, then the electromotor is shut down, thereby the sheet material separation mechanism stops operating.

What are disclosed above are only the preferable embodiments of the invention, the scope of the claims of the invention is of course not limited thereto, therefore, equivalent modifications according to the claims of the invention still belong to the scope covered by the invention.

What is claimed is:

1. A sheet material separation mechanism, comprising a frame, at least one group of conveying wheels, a separation wheel, a reversal wheel, an eccentric adjustment device and a driving component, wherein the at least one group of conveying wheels and the separation wheel are connected to the frame by means of first rotation shafts respectively, the eccentric adjustment device comprises an eccentric plate and an eccentric adjustment plate, the eccentric plate comprises an outer ring and an inner ring suitable for moving within the outer ring, the inner ring is connected with a second rotation shaft, the second rotation shaft is connected with the reversal wheel, the reversal wheel and the separation wheel are spaced apart from each other to form a separating gap, and the driving component drives the first rotation shafts and the second rotation shaft to rotate, wherein the sheet material separation mechanism further comprises an elastic element, one end of the elastic element being fixedly connected to the frame and the other end being connected with the second rotation shaft.

2. The sheet material separation mechanism according to claim 1, further comprising a rolling bearing, the elastic element is connected with the rolling bearing, and the rolling bearing is fitted over the second rotation shaft.

3. The sheet material separation mechanism according to claim 1, wherein the driving component comprises an electromotor and synchronous belts, and the electromotor drives the first rotation shafts and the second rotation shaft to rotate via the synchronous belts.

4. The sheet material separation mechanism according to claim 1, wherein the driving component comprises a manual wheel and synchronous belts, and the manual wheel drives the first rotation shafts and the second rotation shaft to rotate via the synchronous belts, upon an external force being exerted on the manual wheel.

5. The sheet material separation mechanism according to claim 1, wherein the eccentric plate is fixed on one side of the frame, and the eccentric adjustment plate is fixed on the other side of the frame.

6. The sheet material separation mechanism according to claim 1, wherein the friction coefficient of at least a part of the surface of the separation wheel is greater than the friction coefficient of at least a part of the surface of the reversal wheel.

7. The sheet material separation mechanism according to claim 1, wherein the maximum elastic compressive force applied on the second rotation shaft by the elastic element is greater than the acting force applied on the reversal wheel by a sheet material to be separated.

8. The sheet material separation mechanism according to claim 1, further comprising a one-way bearing, the one-way bearing is fitted over the second rotation shaft, the one-way bearing is fitted into the inner ring of the eccentric plate, and the outer diameter of the one-way bearing is smaller than the inner diameter of the inner ring.

* * * * *